US005088653A

United States Patent [19]

Baba

[11] Patent Number: 5,088,653

[45] Date of Patent: Feb. 18, 1992

[54] YARN TRAVERSING METHOD AND A DEVICE FOR CARRYING OUT THE SAME

[75] Inventor: Kenji Baba, Kyoto, Japan

[73] Assignee: Murata Kikai Kabushiki Kaisha, Kyoto, Japan

[21] Appl. No.: 486,437

[22] Filed: Feb. 28, 1990

[30] Foreign Application Priority Data

| | | | |
|---|---|---|---|
| Mar. 4, 1989 | [JP] | Japan | 1-52508 |
| May 19, 1989 | [JP] | Japan | 1-58463[U] |
| May 19, 1989 | [JP] | Japan | 1-58464[U] |
| Jul. 21, 1989 | [JP] | Japan | 1-86369[U] |

[51] Int. Cl.[5] ..... B65H 54/30

[52] U.S. Cl. ..... 242/43 R; 242/43 A

[58] Field of Search ..... 242/43 R, 43 A, 43.1, 242/158.3, 158.2, 158.4 R, 158.5, 158 B, 157 R

[56] References Cited

U.S. PATENT DOCUMENTS

| | | | |
|---|---|---|---|
| 1,170,212 | 2/1916 | Allen et al. | 242/43 A X |
| 2,238,128 | 4/1941 | Nydegger | 242/43 A |
| 2,662,695 | 12/1953 | Ballard | 242/43 A |
| 3,491,962 | 1/1970 | Roberts | 242/43 A |
| 4,165,047 | 8/1979 | Mackie | 242/43 A |
| 4,674,695 | 6/1987 | Kamp et al. | 242/43 A |
| 4,723,721 | 2/1988 | Vehling | 242/43 A X |
| 4,807,822 | 2/1989 | Kamp et al. | 242/43 A X |
| 4,991,783 | 2/1991 | Sugioka | 242/43 A |

FOREIGN PATENT DOCUMENTS

| | | | |
|---|---|---|---|
| 224971 | 12/1983 | Japan | 242/43 A |

*Primary Examiner*—Stanley N. Gilreath
*Attorney, Agent, or Firm*—Spensley, Horn, Jubas & Lubitz

[57] ABSTRACT

The present invention provides a yarn traversing device for traversing a yarn by reciprocating first and second yarn guides respectively along first and second helical cam grooves, comprising a helical cam roller provided with the first and second helical cam grooves each consisting of a substantially linear active traverse groove and a return traverse groove having two curved reversing sections connected respectively to the opposite ends of the active traverse groove. The first and second yarn guides engage the first and second helical cam grooves, respectively, and are disposed one above the other with respect to the running direction of the yarn.

7 Claims, 10 Drawing Sheets

1
2
3
4
5
6
A
B
C
D
E
F
L
M
N
N
10
11
12
13
13
14
14
15
15
R1
R2

21
22

5
19
20

6
5
3a
K1

6
5
3
3a 3
3b
5
R
θ
K2

3
5
θ'

3
3b
5
K3

YARN TRAVERSING METHOD AND A DEVICE FOR CARRYING OUT THE SAME

FIELD OF THE INVENTION

The present invention relates to a method of traversing a yarn and a device for carrying out the same and, more specifically, to a method of traversing a yarn by reciprocating a yarn by yarn guides engaging helical guide grooves, and a device for carrying out the same.

RELATED ART STATEMENT

A conventional method of traversing a yarn by a yarn guide engaging a double helical guide groove is shown in FIG. 6.

A double helical cam groove 2 is formed in the circumference of a cylindrical cam roller 1. A yarn guide 3 engaging the double helical cam groove 2 is reciprocated between the opposite ends of a range G by the cam roller 1. Although it is desirable to form the reversing points, namely, the opposite ends, of the double helical cam groove 2, where the yarn guide 3 is reversed, in an angular shape as shown in FIG. 6 for the ideal reciprocation of the yarn guide 3, a large force acts on both the yarn guide 3 and the reversing sections of the helical cam roller in reversing the yarn guide 3, so that the life of the yarn guide 3 and the helical cam roller 1 is shortened if the reversing points are formed in an angular shape. Accordingly, the opposite reversing sections are formed in a curved shape having a radius of curvature R as indicated by alternate long and short dash lines. However, the curved reversing sections causes the yarn to be wound more in the opposite ends of a yarn package than in the other portion of the same, so that the package is formed in the shape of an hourglass.

Japanese Patent Laid-open (Kokai) Nos. 58-135068 and 58-224972 disclose means as shown in FIG. 7 for reversing the yarn in a moment by the opposite reversing portions of a double helical cam groove 2 formed in a curved shape having a radius of curvature R.

Referring to FIG. 7, a rectangular yarn guide 3 is reciprocated by the double helical cam groove 2 along guide rails 4 and 4'. The left side 3*a* of the yarn guide 3 engages a yarn 5 in moving the yarn to the left and the right side 3*b* of the yarn guide 3 engages the yarn 5 in moving the yarn 5 to the right. Thus, the left side 3*a* and right side 3*b* of the yarn guide 3 guides the yarn 5 alternately to traverse the yarn 5. When the yarn guide 3 approaches one of yarn releasing members 6 provided respectively near the opposite reversing points of the double helical cam groove 2, the yarn 5 runs on the yarn releasing member 6 and is released from the side 3*a* or 3*b* of the yarn guide 3 by the yarn releasing member 6. Upon separation from the yarn guide 3, the yarn 5 reversed suddenly by its own tension. The action of the yarn guide 3 and the yarn releasing members 6 will be described further with reference to FIGS. 8*a*, 8*b*, 8*c*, 8*d* and 8*e* In a stage shown in FIG. 8*a*, the left side 3*a* of the yarn guide 3 is in engagement with the yarn 5 to move the yarn 5 to the left. In a stage shown in FIG. 8*b*, where the yarn guide 3 is at a position slightly before the curved reversing section of the double helical guide groove, the yarn 6 has just run up the yarn releasing member 6 and has just been released from the left side 3*a* of the yarn guide 3. Then, the locus of the yarn 5 changes in a moment in the reverse direction through an angle $\theta$. The angle $\theta$ is dependent on the tension of the yarn 5. In a stage shown in FIG. 8*c*, the yarn guide has arrived at the left end of the stroke and the yarn 5 extends in a free state on the right-hand side of the right side 3*b* of the yarn guide 3. In a stage shown in FIG. 8*d*, the yarn guide 3 has passed the curved reversing section and is moving to the right after the yarn 5. In a stage shown in FIG. 8*e*, the yarn guide 3 has caught up with the yarn 5 and the right side 3*a* of the yarn guide 3 has engaged the yarn 5. Thereafter, the yarn 5 is moved along a locus $K_3$ by the yarn guide 3. Thus, the yarn moves along a locus $K_1$, in which the yarn 3 is in contact with the left side 3*a* of the yarn guide 3, a locus $K_2$, in which the yarn 3 is reversed by its own tension, and the locus $K_3$, in which the yarn 3 is in contact with the right side 3*b* of the yarn guide 3. In FIG. 7, indicated at R is a roller bail, at Sp is a bobbin holder, at B is a bobbin, and at P is a yarn package.

The foregoing conventional yarn traversing method releases the yarn guide 3 to allow the yarn 5 to be reversed by its own tension, and then makes the yarn guide 3 catch up with the yarn 3 to guide the yarn 5 again after the yarn guide 3 has passed the reversing section. Therefore, a portion of the locus of the yarn 5, i.e., the locus $K_2$, is dependent on the tension of the yarn 5 as shown in FIGS. 8*c* and 8*d*, and hence the locus $K_2$ is variable. Furthermore, the locus $K_2$ is dependent also on the type and tension of the yarn, and hence it is difficult to produce uniform yarn packages.

OBJECT AND SUMMARY OF THE INVENTION

The present invention has been made in view of those problems in the prior art and it is therefore an object of the present invention to provide a method of traversing a yarn, capable of traversing the yarn under the continuous control action of a yarn guide and reversing the yarn in a moment at the opposite ends of the stroke, and to provide a device for carrying out the method.

To achieve the object, the present invention provides a method of traversing a yarn by reciprocating first and second yarn guides respectively along first and second helical cam grooves, characterized in that the first and second yarn guides are disposed one above the other with respect to the running direction of the yarn respectively in the first and second helical cam grooves, each of the first and second helical cam grooves consists of a substantially linear active traverse groove and a return traverse groove having two curved reversing sections connected respectively to the opposite ends of the active traverse groove, the first and second helical cam grooves are formed so that one of the first and second yarn guides is moving along the return traverse groove of the corresponding helical cam groove while the other yarn guide is moving along the active traverse groove of the corresponding helical cam groove, and the yarn is transferred from one of the first and second yarn guides at the terminating end of the active traverse groove of the corresponding helical guide groove to the other yarn guide at the starting end of the active traverse groove of the corresponding helical cam groove.

The present invention provides a yarn traversing device for traversing a yarn by reciprocating first and second yarn guides respectively along first and second helical cam grooves, comprising: a helical cam roller provided with the first and second helical cam grooves each consisting of a substantially linear active traverse groove and a return traverse groove having two curved reversing sections connected respectively to the opposite ends of the active traverse groove; characterized in that the first and second yarn guides engage the first and second helical cam grooves, respectively, the first and second helical cam grooves are formed so that the active traverse groove of one of the first and second helical cam grooves extend along the return traverse groove of the other helical cam groove, the first and second yarn guides are disposed one above the other with respect to the running direction of the yarn, a yarn slip-off preventing guide is disposed between the upper and lower yarn guides within a virtual guide range, and two yarn releasing guides are disposed respectively at the opposite ends of the virtual guide range.

As shown in FIG. 4, the first yarn guide engages the first helical cam groove having the active traverse groove 1 to 2 , and the return traverse groove to 2 to 3 , and the second yarn guide engages the second helical cam groove having the active traverse groove to 5 to 6 , and the return traverse groove 4 to 5 . While one of the first and second yarn guides is guiding the yarn within the virtual guide range corresponding to a winding width, the other yarn guide is in the return stroke without engaging the yarn, and the yarn is transferred from one of the first and second yarn guides to the other yarn guide at the end of the virtual guide range. Thus, the first and second yarn guides guide the yarn alternately to traverse the yarn so that the stroke of the yarn is reversed in a moment at the opposite ends of the virtual guide range, the first and second yarn guides are moved for alternate yarn guide stroke and return stroke, and each of the first and second yarn guides is reversed at moderate speed along the curved reversing sections.

When a single helical cam roller is used, the two yarn guides are disposed necessarily one above the other, and the yarn slip-off preventing guide prevents the yarn from slipping off the yarn guides at a position where the respective phases of the two yarn guides coincide with each other (point A in FIG. 4). The yarn releasing guide transfers the yarn from one of the two yarn guides to the other.

DETAILED DESCRIPTION OF PREFERRED EMBODIMENTS

A preferred embodiment of the present invention will be described hereinafter with reference to the accompanying drawings.

Figure 1:
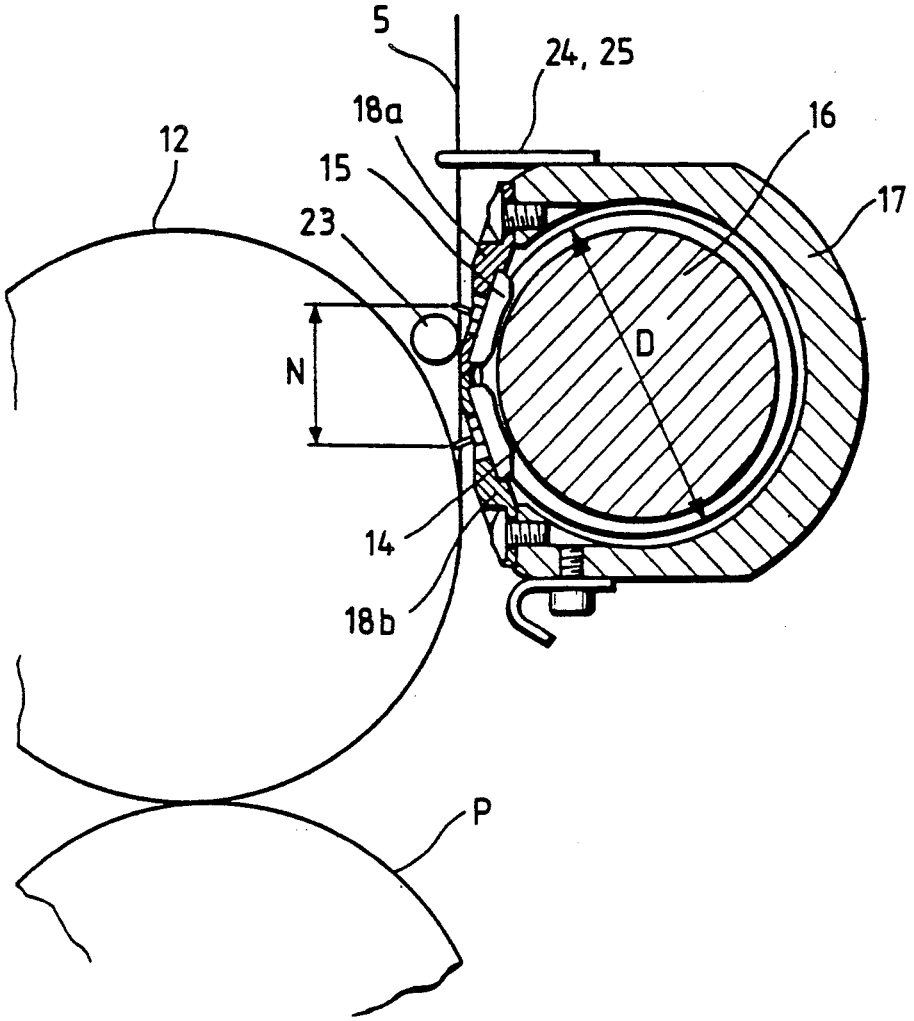
FIG. 1 is a sectional view of a yarn traversing device embodying the present invention.
Figure 2:
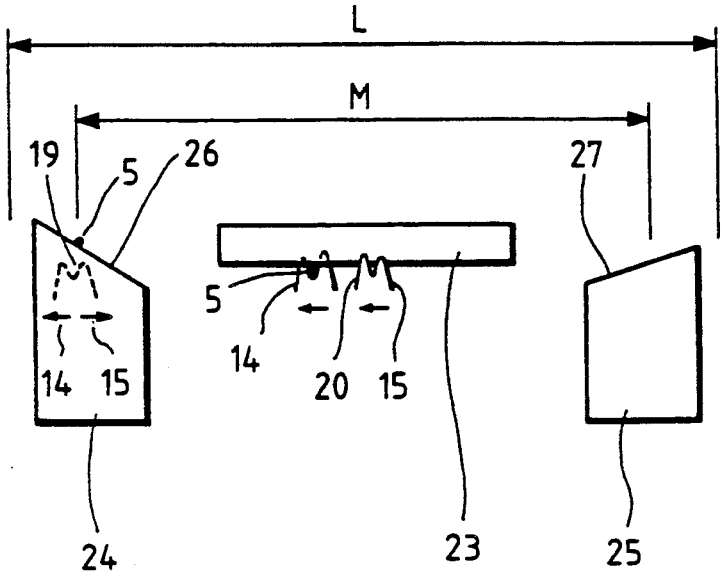
FIG. 2 is a top plan view showing the positional relation between a yarn slip-off preventing guide and yarn releasing guides included in the yarn traversing device.
Figure 3:
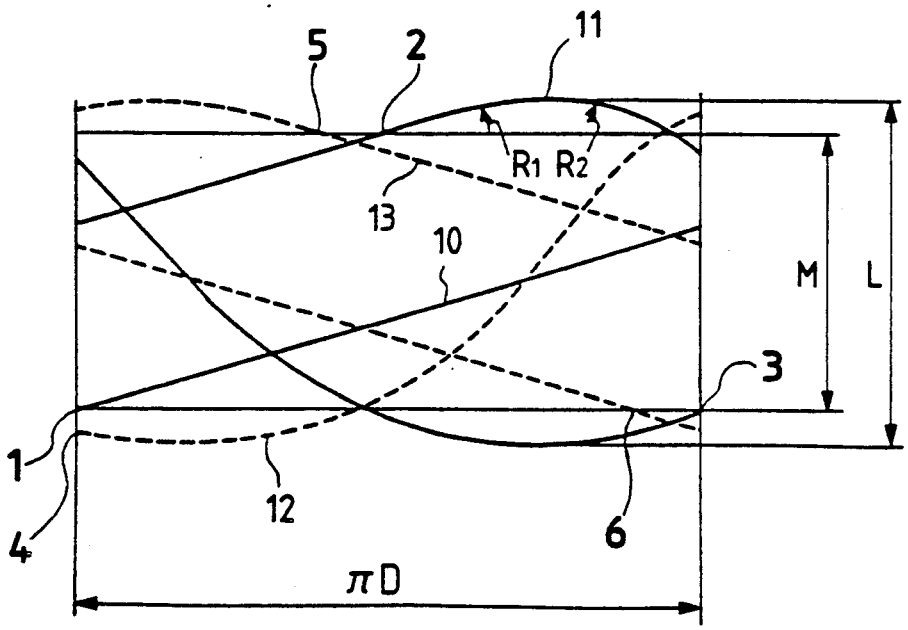
FIG. 3 is a diagram showing the development of a helical cam roller.
Figure 4:
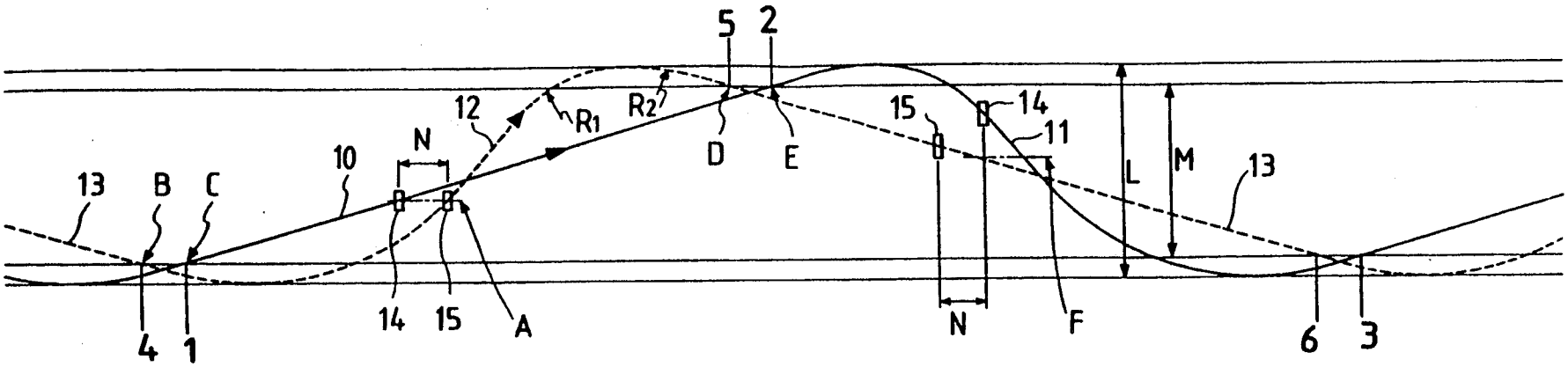
FIG. 4 is a transcribed development of two helical cam grooves.
Figure 5B:
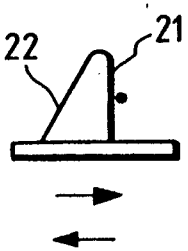
FIGS. 5*a* and 5*b* are side elevations of yarn guides.
Figure 5A:
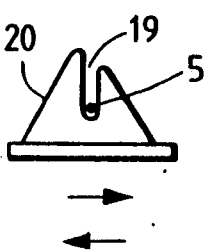
Figure 6:
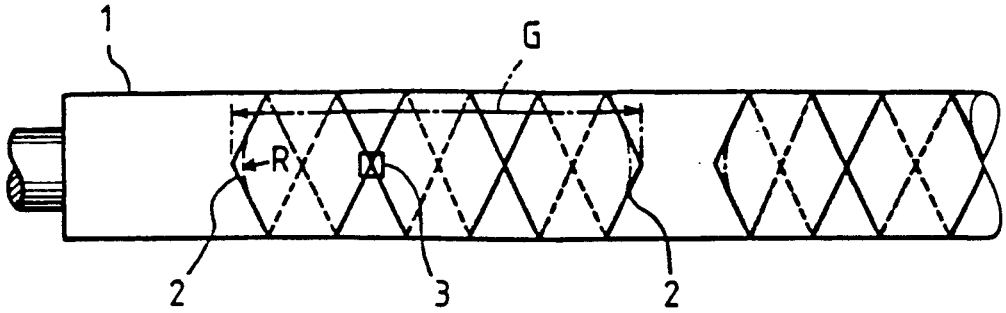
FIG. 6 is a diagram showing the development of the double helical cam grooves of a conventional helical cam roller.
Figure 7:
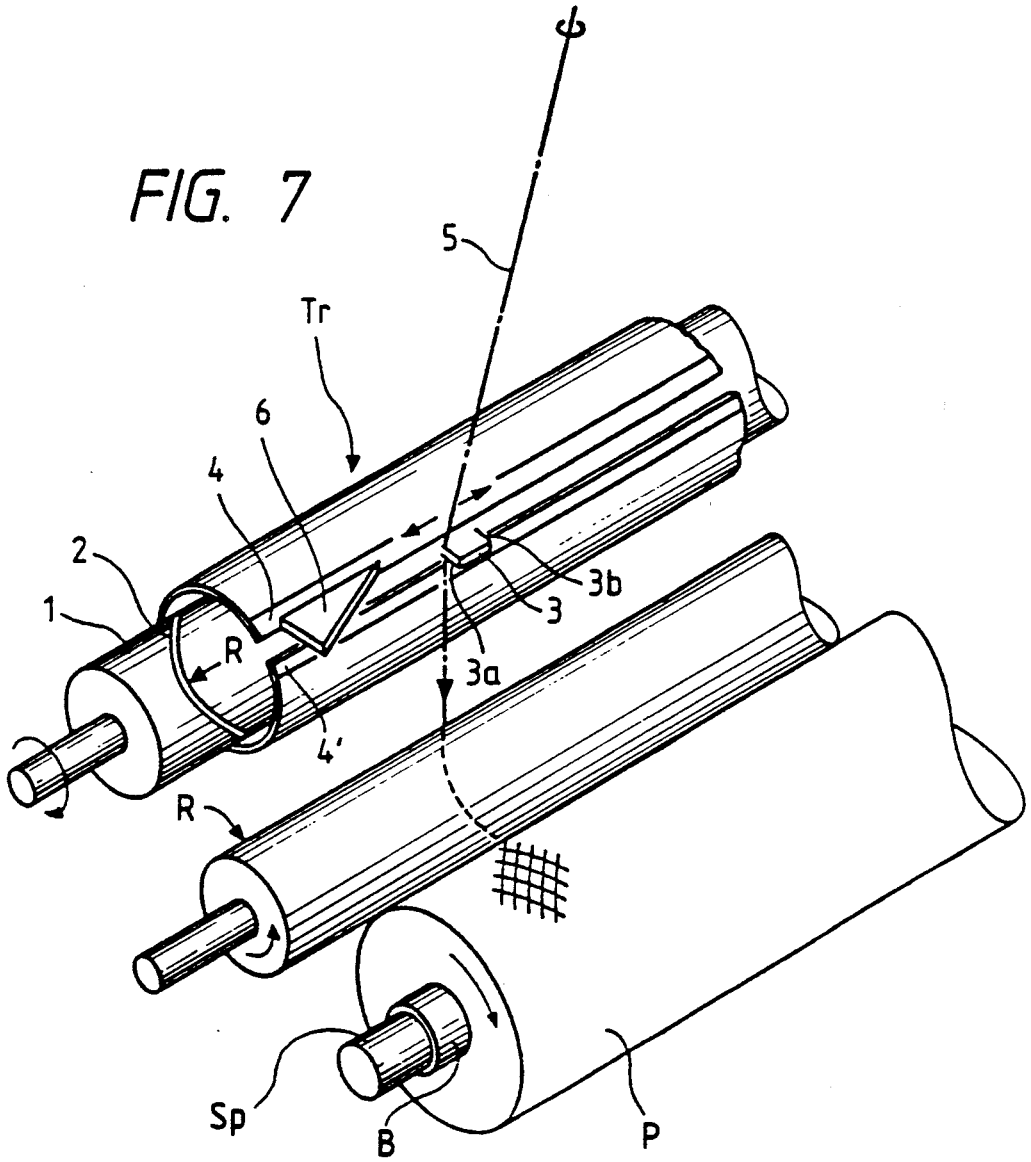
FIG. 7 is a perspective view of a conventional yarn traversing device.
Figures 8A, 8B, 8C, 8D, 8E:
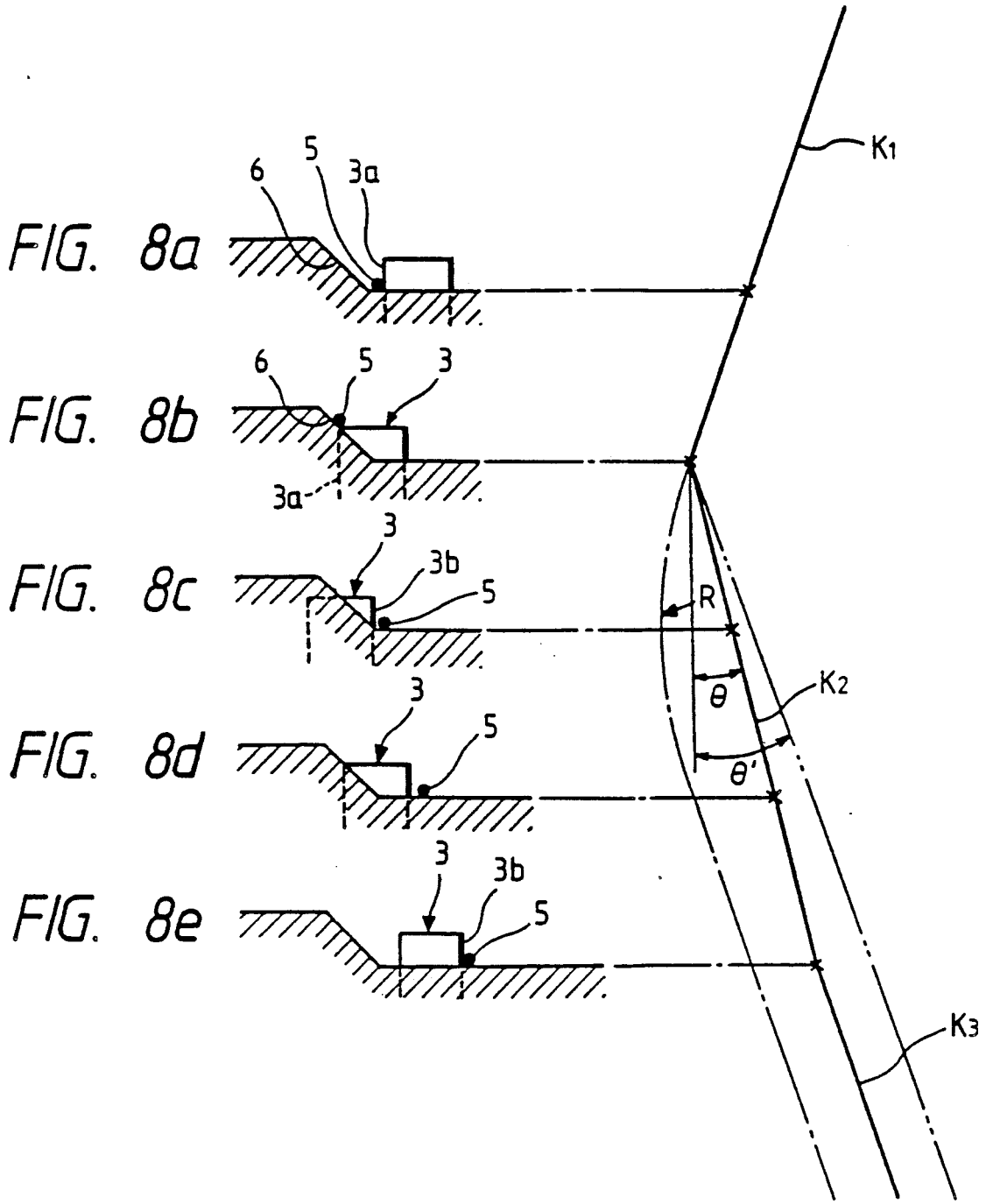
FIGS. 8*a*–8*e* are diagrammatic illustrations assistance in explaining the operation of the conventional yarn traversing device.

FIG. 1 is a sectional view of a yarn traversing device embodying the present invention, FIG. 2 is a top plan view showing the relative disposition of a yarn slip-off preventing guide and yarn releasing guides in the yarn traversing device, FIG. 3 is a diagram showing the development of a helical cam roller, FIG. 4 is a diagram of the transcribed development of the helical cam roller, and FIGS. 5*a* and 5*b* are illustrations of yarn guides.

A method of traversing a yarn will be described with reference to FIGS. 3 and 4 as carried out, as a matter of convenience, by a yarn traversing device shown in FIG. 1 comprising a single helical cam roller, and two yarn guides engaging the helical cam grooves formed in the circumference of the helical cam roller, but the method can be carried out by a yarn traversing device comprising two helical cam rollers and two yarn guides combined respectively with the two helical cam rollers.

Referring to FIG. 3, a helical cam roller 16 is provided with a first helical cam groove consisting of a first active traverse groove 10 ( 1 to 2 ) extending substantially linearly within a virtual traverse range M and a first return traverse groove 11 ( 2 to 3 ) extending within a traverse range L and having gently curved reversing sections $R_1$ and $R_2$ at the opposite ends thereof, and a second helical cam groove consisting of a second return traverse groove 12 ( 4 to 5 ) extending within the traverse range L and having gently curved reversing sections at the opposite ends thereof and a second active traverse groove 13 ( 5 to 6 ) extending substantially linearly within the virtual traverse range M. FIG. 4 is a transcribed development of the first and second helical cam grooves for facilitating understanding the positional relation between the first and second helical cam grooves.

Referring to FIG. 4, a first yarn guide 14 engaging the first helical cam groove 1 → 2 → 3 , and a second yarn guide 15 engaging the second helical cam groove 4 → 5 →6 maintain a center spacing N with respect to the direction of travel of a yarn. The first yarn guide 14 is moved by the first active traverse groove 1 to 2 for traversing the yarn and the second yarn guide 15 is moved by the second active traverse groove 5 to 6 for traversing the yarn to thereby instantaneously reverse the traverse direction of the yarn at the opposite ends of the virtual traverse range M. The yarn is transferred from the first yarn guide 14 to the second yarn guide 15 when the first yarn guide reaches the point E and the second yarn guide reaches the point D. Similarly, the yarn is transferred from the second yarn guide 15 to the first yarn guide 14 when the second yarn guide reaches the point B and the first yarn guide reaches the point C. During the time that the first yarn guide 14 engages the first active traverse groove 10 and guides the yarn, the second yarn guide 15 travels along the second return traverse groove 12 through the gently curved reversing section $R_1$ or $R_2$.

A yarn traversing device for carrying out the method will be described hereinafter.

Referring to FIG. 1, a helical cam roller 16 is journaled for rotation in a cam drum 17. A first helical cam groove 1 → 2 → 3 and a second helical cam groove 4 → 5 → 6 are formed in the circumference of the helical cam roller 16. A plurality of sets of the first and second helical cam grooves are arranged axially so as to correspond respectively to a plurality of yarn packages P. The cam drum 17 is provided with guide rails 18*a* and 18*b* respectively for guiding first yarn guide 14 and a second yarn guide 15 for axial traverse motion maintaining a center distance N therebetween with respect to the direction of travel of a yarn. The construction of the first and second helical cam grooves is the same as that described with reference to FIGS. 3 and 4. The construction and action of the first yarn guide 14 and the second yarn guide 15 will be described hereinafter.

Referring to FIG. 5*a*, a yarn guide having generally triangular shape is provided with a slit 19 in the central portion to receive a yarn 5 therein. The upper end of the left side 20 is higher than the upper end of the right side. Therefore, the yarn 5 is raised by the left side 20 and the yarn guide passes under the yarn 5 when the yarn guide is moved to the left. A yarn guide shown in FIG. 5*b* is formed in the shape of a right triangle and has an upright side 21 for guiding the yarn 5, and an inclined side 22. Either the yarn guide shown in FIG. 5*a* or the yarn guide shown in FIG. 5*b* may be used. Both the yarn guides are able to guide the yarn when moved to the right and are unable to guide the yarn when moved to the left. When either of such yarn guides is used, the yarn traversing device needs a yarn slip-off preventing guide 23 and yarn releasing guides 24 and 25 as shown in FIG. 2. The yarn slip-off preventing guide 23 is extended in parallel to the axis of the helical cam roller 16 between the yarn guides 14 and 15 as shown in FIG. 1 in the middle of the virtual traverse range M as shown in FIG. 2. The length of the yarn slip-off preventing guide 23 is about half the width of the virtual traverse range M. The yarn slip-off preventing guide 23 obstructs the movement of the yarn 5 away from the yarn guide, i.e., to the left, as viewed in FIG. 1. The yarn slip-off preventing guide 23 prevents the yarn from slipping off the yarn guide at a point A or F in FIG. 4 due to the passage of the other yarn guide under the yarn 5. When the second yarn guide 15 passes under the yarn 5 being guided by the first yarn guide 14 moving to the right at the point A, the inclined side of the second yarn guide 15 raises the yarn 5, but the yarn slip-off preventing guide 23 prevents the yarn from slipping off the first yarn guide 14. Therefore, the second yarn guide 15 moves under the yarn 5 past the first yarn guide 14. The actions of the first yarn guide 14 and the second yarn guide 15 are reversed merely at the point F.

The yarn releasing guides 24 and 25 are attached to the upper surface of the cam drum 17 respectively at positions corresponding to the opposite ends of the virtual traverse range M with the respective inclined sides 26 and 27 facing each other (FIGS. 1 and 2). The front end of the inclined side 26 is closer to the yarn package P than the front end of the inclined side 27. The function of the yarn releasing guide 27 in transferring the yarn from one of the yarn guides to the other yarn guide at points D and E (FIG. 4) will be described. Upon the arrival of the first yarn guide 14 at the point E, the second yarn guide 15 arrives at the point D. As shown in FIG. 2, the yarn 5 is released from the slit 19 by the inclined side 26 and the first yarn guide 14 moves further to the left. The second yarn guide 15 directly above the first yarn guide 14 moves to the right along the first active traverse groove 13 ( 5 to 6 in FIG. 4) to guide the yarn 5. Since the first yarn guide 14 is more away from the yarn releasing guide 24 than the second yarn guide 15, the inclined side 26 is projected more to the front than the inclined side 27 to ensure releasing the yarn 5 from the first yarn guide 14..

The operation of the yarn traversing device thus constructed will be described hereinafter with reference to FIGS. 2 and 4.

Referring to FIG. 4, the first yarn guide 14 is moved by the first active traverse groove 10 ( 1 to 2 ) to guide the yarn 5. When the second yarn guide 15 passes the first yarn guide 14 at the point A, the yarn slip-off preventing guide 23 prevents the yarn 5 from slipping off the first yarn guide 14. Upon the arrival of the first yarn guide 14 at the point E, the yarn 5 is transferred from the first yarn guide 14 to the second yarn guide 15 by the yarn releasing guide 24. Then, the second yarn guide 15 is moved along the second active traverse groove ( 5 to 6 ) to guide the yarn 5. Thus, the yarn 5 is traversed as the first yarn guide 14 moves along the first active traverse groove 1 to 2 and the second yarn guide 15 moves along the second active traverse groove 5 to 6 , and the yarn 5 is reversed in a moment in changing the direction of traverse motion. The first yarn guide 14 and the second yarn guide 15 are reversed for return travel along the gently curved sections of the return traverse grooves.

The present invention has the following effects.

Since the first and second yarn guides are disposed one above the other with respect to the running direction of the yarn respectively in the first and second helical cam grooves each consisting of an active traverse groove and a return traverse groove having curved reversing sections at the opposite ends thereof, the first and second helical cam grooves are formed so that one of the first and second yarn guides is moving along the return traverse groove of the corresponding helical cam groove while the other yarn guide is moving along the active traverse groove of the corresponding helical cam groove, and the yarn is transferred from one of the first yarn guide and the second yarn guide at the terminating end of the active traverse groove of the corresponding helical cam groove to the other yarn guide at the starting end of the active traverse groove of the corresponding helical cam groove and vice versa, the yarn can be reversed in a moment at the fixed positions, so that the yarn can be wound in a yarn package having a uniform shape and formation of a yarn package having the shape of an hourglass can be prevented.

Since the yarn traversing device comprises a single helical cam roller provided with first and second helical cam grooves each consisting of a substantially linear active traverse groove and a return traverse groove having two curved return sections connected respectively to the opposite ends of the active traverse groove, and formed in the circumference of the helical cam roller so that the active traverse groove of one of the first and second helical cam grooves and the return traverse groove of the other helical cam groove extend by pair, first and second yarn guides disposed one above the other with respect to the running direction of the yarn and respectively engaging the first and second helical cam grooves, a yarn slip-off preventing guide extended within a virtual traverse range between the first and second yarn guides, and yarn releasing guides disposed at the opposite ends of the virtual traverse range, the yarn guides do not guide the yarn while the same are moving along the corresponding return traverse grooves and the yarn guides are moved at a moderate speed along the corresponding curved return sections in reversing the direction of travel, so that the abrasion of the yarn guides is reduced.

Another embodiment of the traversing device of the present invention will be illustrated.

A yarn traversing device of this embodiment comprises: a rotary helical cam roller provided with a paired couple of helical cam grooves in the circumference thereof; and paired upper and lower guide rails disposed near the outer circumference of the helical cam roller so as to extend in parallel to the axis of the helical cam roller with a fixed gap therebetween, and two yarn guides respectively engaging the helical cam grooves for traverse motion along the axis of the helical cam roller, characterized in that the two yarn guides have each a shoe, a slider provided on one end of the shoe and engaging the guide groove of the corresponding guide rail, and a yarn guide extensive provided on the other end of the shoe so as to project through the gap between the upper and lower guide rails to the front.

Each of the two yarn guides has the slider and the yarn guide extension separately provided respectively on the opposite sides of the shoe, and the two yarn guides are disposed opposite to each other respectively on the guide rails so that the yarn guide extensions project near to each other from the gap between the guide rails.

The embodiment of the present device will be described hereinafter with reference to the accompanying drawings.

Figure 9:
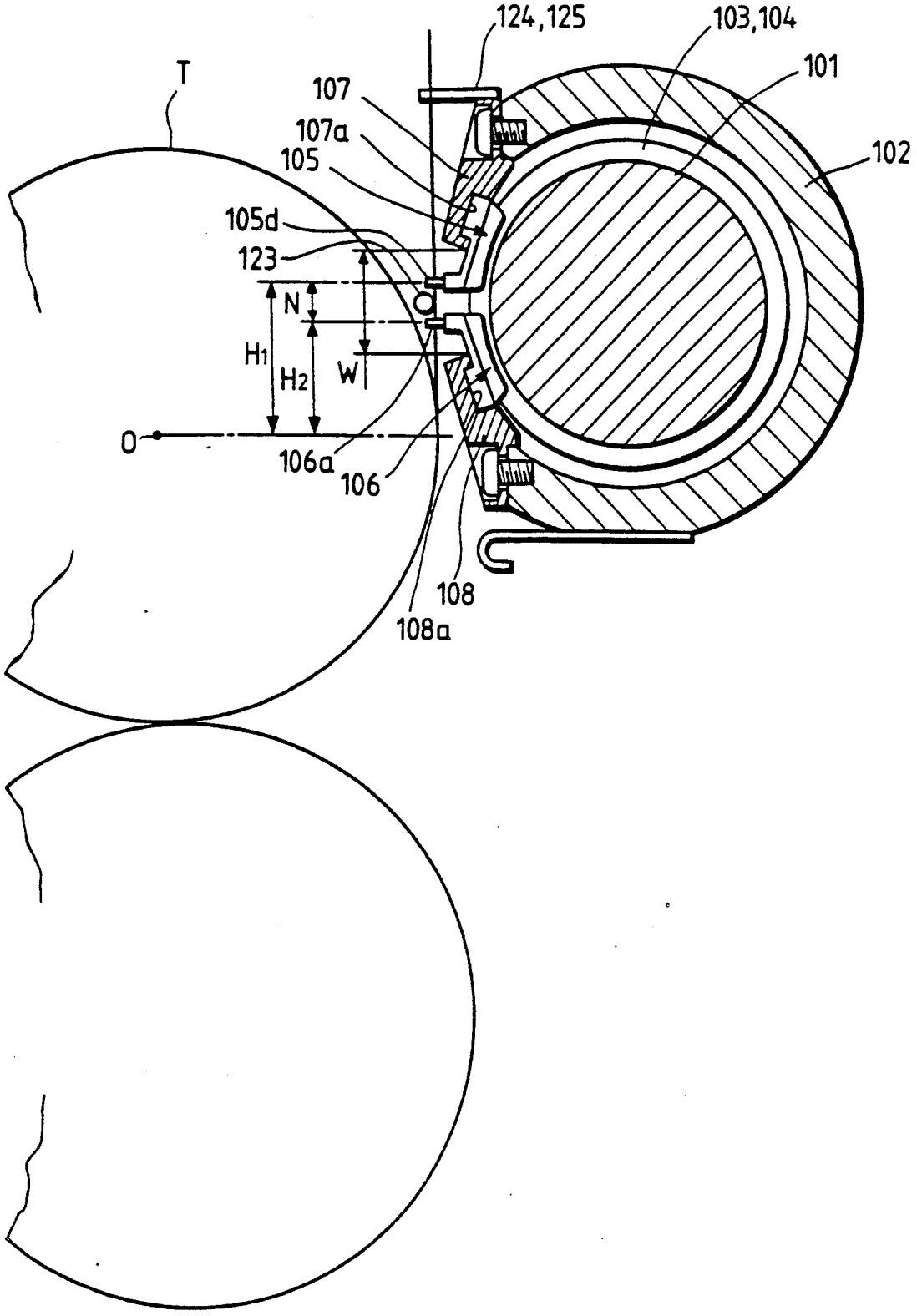
FIG. 9 is a sectional view of a yarn traversing device of a second embodiment of the present invention.
Figure 10A:
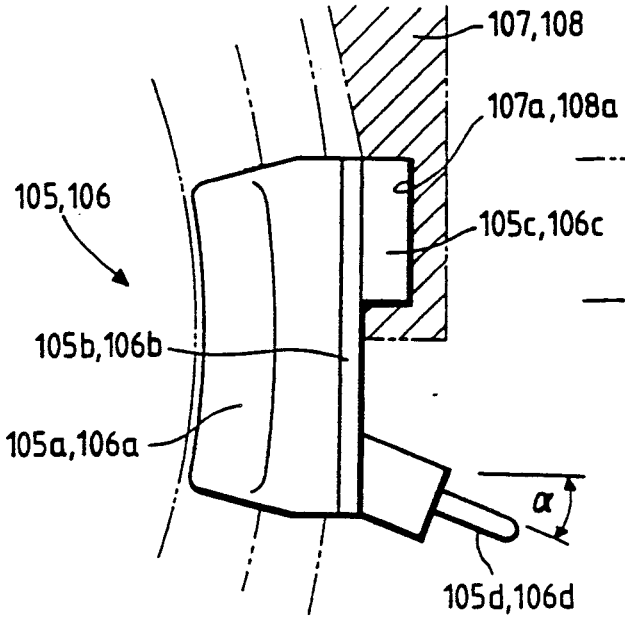
FIGS. 10*a*, 10*b*, and 10*c* are sectional views of a yarn guide of the second embodiment.
Figure 10B:
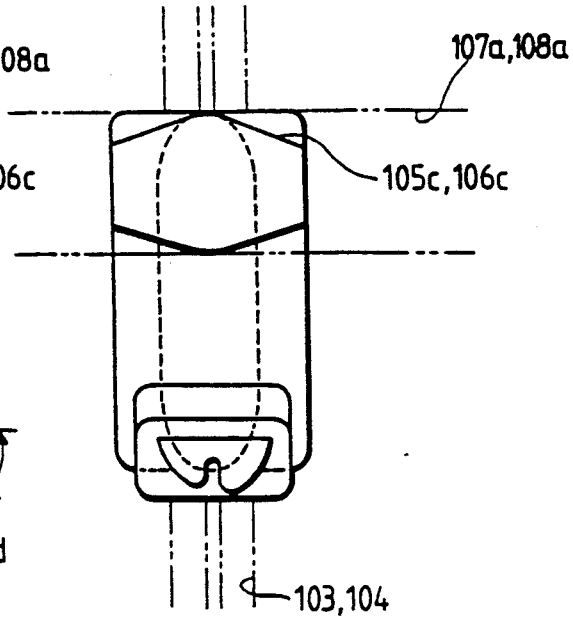
Figure 10C:
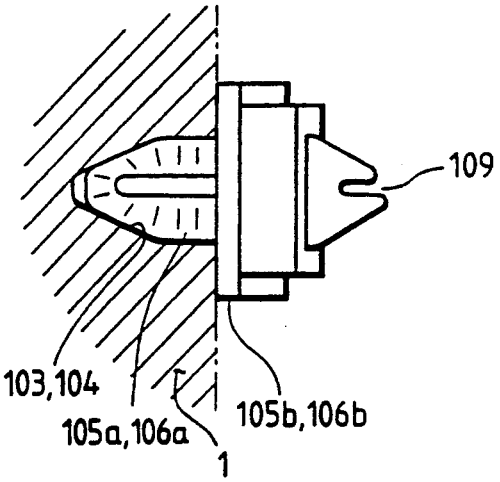

FIG. 9 is a sectional view of a yarn traversing device embodying the present device, and FIGS. 10*a*, 10*b* and 10*c* are views of a yarn guide.

Referring to FIG. 9, a helical cam roller 101 is journaled for rotation in a cam drum 102 and is provided in its circumference with two helical cam grooves 103 and 104. Yarn guides 105 and 106 are disposed one above the other with respect to the running direction of a yarn and engage the helical cam grooves, respectively. Guide rails 107 and 108 for guiding the yarn guides 105 and 106 for reciprocation are disposed opposite to each other.

The guide rails 107 and 108 are provided respectively with guide grooves 107*a* and 108*a* having a rectangular cross section and extending in parallel to the axis of the helical cam roller 101 in their respective inner surfaces facing the helical cam roller 101. The guide grooves 107*a* and 108*a* and the helical cam grooves 103 and 104 control the yarn guides 105 and 106 for reciprocation. The guide rails 107 and 108 are disposed symmetrically with respect to a horizontal plane including the center axis of the helical cam roller 101 so as to form a gap W extending in parallel to the helical cam roller 101.

Referring to FIGS. 10*a*, 10*b* and 10*c*, the yarn guide 105 (106) comprises a shoe 105*a* (106*a*) engaging the helical cam groove 103 (104), a base 105*b* (106*b*), a slider 105*c* (106*c*) projecting from one end of the base 105*b* (106*b*) and fitted in the guide groove 107*a* (108*a*) of the guide rail 107 (108), and a yarn guide extension 105*d* (106*d*) projecting obliquely from the other end of the base 105*b* (106*b*). The shoe 105*a* (106*a*) is formed in the shape of a boat fitting the helical cam groove 103 (104) to enable the shoe 105*a* (106*a*) to slide smoothly along the helical cam groove 103 (104). The base 105*b* (106*b*) serves as a flange separating the shoe 105*a* (106*a*) engaging the helical cam groove 103 (104), and the slider 105*c* (106*c*) engaging the guide groove 107*a* (108*a*). The base 105*b* (106*b*) is not necessarily indispensable; the slider 105*c* (106*c*) may be provided on the shoe 105*a* (106*a*). As best shown in FIG. 10*b*, the slider 105*c* (106*c*) has a substantially rhombic shape and its opposite edges are in sliding contact respectively with the opposite side surfaces of the guide groove 107*a* (108*a*). Therefore, the yarn guide 105 (106) is able to reciprocate in a position conforming to the direction of extension of the helical cam groove 103 (104). As best shown in FIG. 10*c*, the yarn guide extension 105*d* (106*d*) has a slit 109 for holding the yarn. The yarn guide extension 105*d* (106*d*) has a tip made of a thin plate, and a base formed in a large thickness to secure a sufficient strength. The inclination $\alpha$ of the yarn guide extensions 105*d* and 106*d* are determined selectively so that the tips of the yarn guide extensions 105*d* and 106*d* extend in parallel to each other as shown in FIG. 9 when the yarn traversing device is assembled.

Thus, the yarn traversing device can be constructed so that the distance N between the yarn guide extensions 105*d* and 106*d* of the yarn guides 105 and 106 is an optional small value as shown in FIG. 9. Accordingly, the free length $H_1$ corresponding to the vertical distance between the center 0 of the roller bail T and the yarn guide extension 105*d* can be reduced considerably, while the free length $H_2$ corresponding to the vertical distance between the center O of the roller bail T and the yarn guide extension 106*d* is about the same with that of the yarn traversing device as that shown in FIG. 1. Thus, unstable factors attributable to the difference in free length between the yarn guide extensions 105*d* and 106*d* can be eliminated, and sensitivity can be improved by reducing the respective free lengths $H_1$ and $H_2$ of the yarn guide extensions 105*d* and 106*d*.

The yarn traversing device of this embodiment employs two, yarn guides each having a slider and a yarn guide extension provided respectively on the opposite ends of a shoe, and provided opposite to each other respectively on two parallel guide rails so that the yarn guide extensions are close to each other and project from the gap between the guide rails. Therefore, the free lengths of the yarn guides and the difference between the free lengths are reduced and hence the immunity of the yarn traversing device to the variation of the yarn tension and external disturbance is enhanced. Thus, the cooperative actions of the two yarn guides traverse the yarn stably and reduce the possibility of cobwebbing and winding the yarn in a package having an irregular shape.

Furthermore, still another embodiment of the yarn guides 14 and 15, and the yarn guides 105 and 106 will be described.

The present device provides a yarn traversing device employing first and second yarn guides for traversing a yarn respectively in opposite directions. The yarn guide members of the first and second yarn guides substantially axially symmetrical with each other. Each yarn guide member has a taller inclined side for raising a yarn, a shorter inclined side for taking in the yarn, a yarn guide slit formed between the taller inclined side and the shorter inclined side, and a yarn holding recess formed in the side surface of the slit on the side of the shorter inclined side.

When one of the first and second yarn guides in a return stroke passes the other yarn guide in an active stroke and engaging the yarn, the taller inclined side of the former raises the yarn and passes under the yarn. However, the yarn guide engaging the yarn holds the yarn in the yarn holding recess formed in the side surface of the slit on the side of the shorter inclined side.

The embodiment according to the present device will be described hereinafter with reference to the accompanying drawings.

Figure 11A:
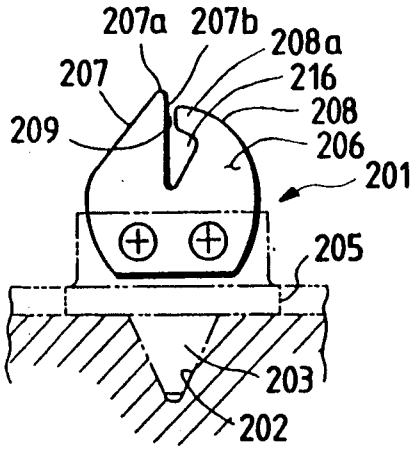
FIGS. 11*a* and 11*b* are sectional views of a yarn guide of a third embodiment of the present invention.
Figure 11B:
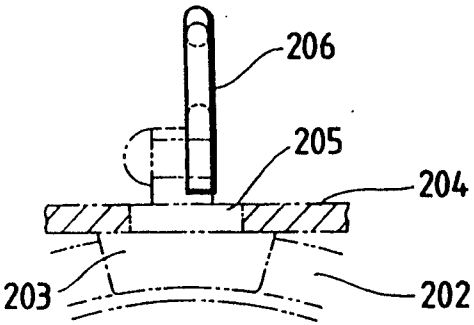

FIGS. 11*a* and 11*b* are views of a yarn guide employed in a yarn traversing device embodying the present device, and FIGS. 12*a*, 12*b*, 12*c* and 12*d* are views of assistance in explaining the action of the yarn guide.

FIG. 11*a* is a plan view of the yarn guide and FIG. 11*b* is a side elevation of the yarn guide. A yarn guide 201 comprises a shoe 203 which engages a helical cam groove 202 for sliding movement, a base 205 to be guided by a guide rail 204, and a yarn guide member 206 fastened to the base 205 with screws. Since the yarn guide member 206 is a consumable part, the yarn guide member 206 is attached with the screws for replacement. The shoe 203, the base 205 and the yarn guide member 206 may be formed of a resin by molding in an integral unit. The yarn guide member 206 has a taller inclined side 207, a shorter inclined side 208, a slit 209 formed between the taller inclined side 207 and the shorter inclined side 208, and a yarn holding recess 216 formed in the side surface of the slit 209 on the side of the shorter inclined side 208. The taller inclined side 207 is a straight slope capable of raising a yarn to pass under the yarn. When the taller inclined side 207 engages the yarn to pass under the same, the yarn rolls up the taller inclined side 207, and then jumps from the extremity 207*a* of the taller inclined side 207 over the shorter inclined side 208 to enable the yarn guide 201 pass under the yarn. The shorter inclined side is a curved slope having the shape of an arc of a circle capable of guiding a yarn into the slit 209. When the shorter inclined side 208 engages a yarn, the yarn rolls up the shorter inclined side 208, is stopped by the taller side surface 207*b* of the slit 209 extending from the extremity 207*a* of the taller inclined side 207, and then falls into the slit 209. The shorter inclined side 208 is formed in the shape of an arc of a circle to obviate the reduction of the width of a portion of the yarn guide 201 between the side surface of the slit 209 and the shorter inclined side 207 to an unacceptable width by the yarn holding recess 216. The yarn holding recess 216 replaces the yarn slip-off preventing member as a means of preventing a yarn from slipping off the yarn guide. The yarn holding recess 216 is a triangular recess formed in the middle of the side surface of the slit 209 on the side of the shorter inclined side 208 and has an angular bottom 216*a*.

Figure 12A:
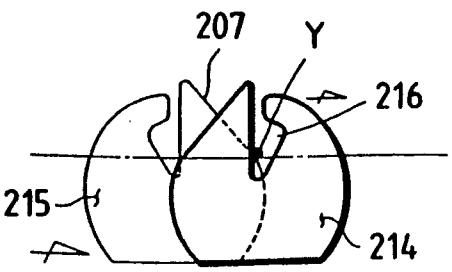
FIGS. 12*a*, 12*b*, 12*c* and 12*d* are sectional views of assistance in explaining the action of yarn guides shown in FIGS. 11*a* and 11*b*.
Figure 12B:
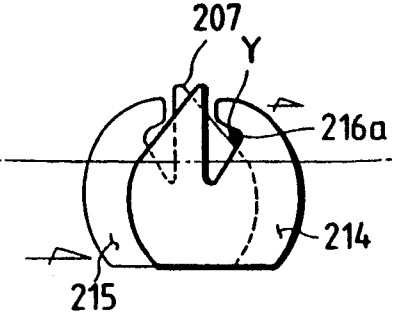
Figure 12C:
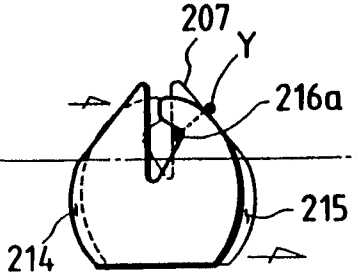
Figure 12D:
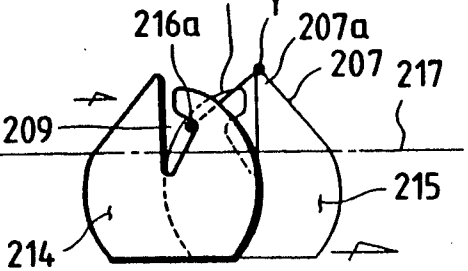

The yarn guide for traversing the yarn in one direction and the yarn guide for traversing the yarn in the opposite direction are substantially axially symmetrical with each other. The two yarn guides axially symmetrical with each other are disposed one above the other as shown in FIG. 12*a*. The two yarn guides need not necessarily be perfectly axially symmetrical with each other; the taller side 207 for raising a yarn, the shorter side 208 for taking in a yarn, and the yarn holding recess 216 of one of the yarn guides may simply be inverted with respect to those of the other yarn guide.

The actions of the yarn guides will be described hereinafter with reference to FIGS. 12*a*, 12*b*, 12*c* and 12*d* on an assumption that the first yarn guide 214 for traversing a yarn Y in one direction, i.e., to the right in FIGS. 12*a* to 12*d*, indicated by thick lines is in an active stroke to traverse the yarn Y, and the second yarn guide 215 for traversing the yarn Y in the opposite direction, i.e., to the left in FIGS. 12*a* to 12*d*, indicated by thin lines is in a return stroke and passes the first yarn guide 214. Referring to FIG. 12*a*, the second yarn guide 215 has overtaken the first yarn guide 214, the taller inclined side 207 of the second yarn guide 215 is in engagement with the yarn Y held by the first yarn guide 214, and the second yarn guide 215 is running further beyond the first yarn guide 214. As the second yarn guide 215 moves further to the right, the yarn Y climbs up the taller side 207 of the second yarn guide 215 and moves toward the yarn holding recess 216. In a state shown in FIG. 12*b*, the yarn Y has been pressed against the angular bottom 216*a* of the first yarn guide 214 by the inclined side 207 of the second yarn guide 215. In a state shown in FIG. 12*c*, the yarn Y is held at the angular bottom 216*a* and extends obliquely between the angular bottom 16*a* of the first yarn guide 124 and the taller inclined side 207 of the second yarn guide 215. In a state shown in FIG. 12*d*, the yarn Y has reached the extremity 207*a* of the taller side 207 of the second yarn guide 215 and is about to jump over the shorter inclined side 208 of the second yarn guide 215 to allow the second yarn guide 215 to pass under the yarn Y. After the yarn Y has thus jumped over the second yarn guide 215, the yarn Y is restored to the initial position in the depth of the slit 209 of the first yarn guide 214 by its own tension. Thus, the use of the yarn guide member having such a shape enables the yarn guide to pass under the yarn running beyond the preceding yarn guide.

The shape of the yarn holding member need not be limited to that described with reference to FIG. 11*a*; the yarn holding member may be formed in any suitable shape provided that the yarn holding member has a taller inclined side for raising the yarn, a shorter inclined side for taking in the yarn, a slit formed between the taller inclined side and the shorter inclined side, and a recess formed in the side surface of the slit on the side of the shorter inclined side.

The yarn traversing device of this embodiment employs a first yarn guide for traversing the yarn in one direction and a second yarn guide for traversing the yarn in the opposite direction respectively having yarn holding members which are substantially axially symmetrical with each other, and each yarn holding member has a taller inclined side for raising the yarn to make the yarn jump over the yarn guide, a shorter inclined side for taking in the yarn, a slit formed between the taller inclined side and the shorter inclined side, and a yarn holding recess formed in the side surface of the slit on the side of the shorter inclined side. When the yarn guide in the return stroke passes the other yarn guide in the active traversing stroke, the former yarn guide raises the yarn by the taller inclined side to pass under the yarn, while the latter yarn guide continues to hold the yarn in its yarn holding recess. Accordingly, the yarn traversing device need not be provided with the yarn slip-off preventing guide, and hence any work for adjusting the yarn slip-off preventing guide is unnecessary. Furthermore, the free lengths and the difference between the free lengths are reduced thereby enhancing the immunity of the yarn traversing device to the variation of yarn tension and external disturbance. Consequently, the yarn can stably be traversed along a constant path by the cooperative action of the two yarn guides and hence the possibility of cobwebbing and winding the yarn in an irregular shape is reduced.

Further embodiment of the present invention concerning an arrangement of the traversing guides will be illustrated.

The present device provides a yarn traversing device comprising two yarn guides disposed so that the extremities thereof are in contact with the yarn when a yarn releasing guide acts on the yarn. Such an arrangement is established by using yarn guides having different lengths or by tilting a cam drum having the yarn guides so that the yarn guides are disposed substantially perpendicularly to the path of the yarn.

When the yarn guides are so disposed that the extremities thereof are in contact with the yarn when the yarn releasing guide acts on the yarn, one of the yarn guides is directly below the other yarn guide with respect to the path of the yarn at a moment when the yarn is released from the former yarn guide, so that the yarn is never allowed to float and interference is obviated.

The embodiment of yarn traversing devices will be described hereinafter with reference to the accompanying drawings.

Figure 13:
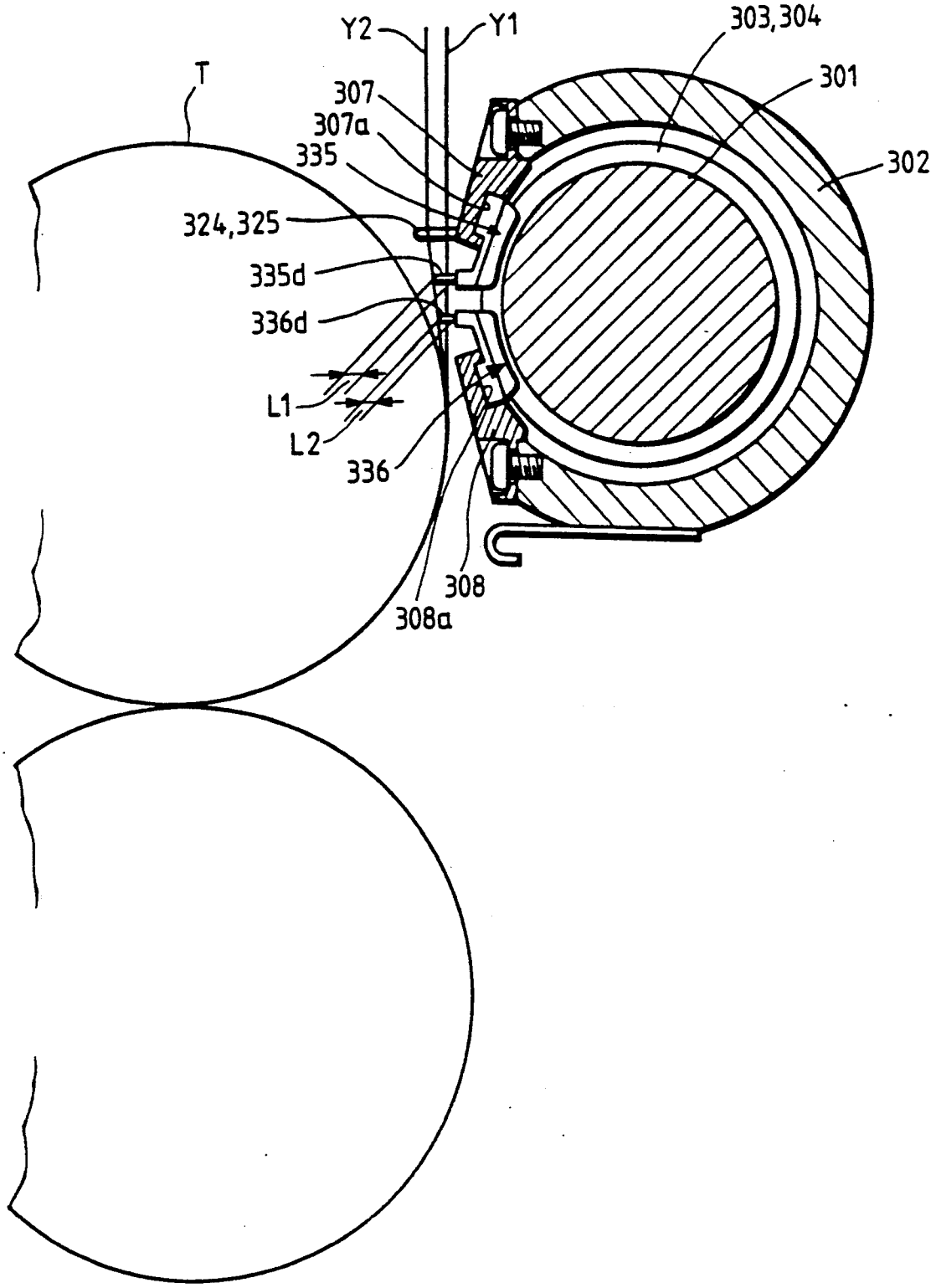
FIGS. 13 and 14 are sectional views of yarn traversing devices of a fourth embodiment of the present invention.
Figure 14:
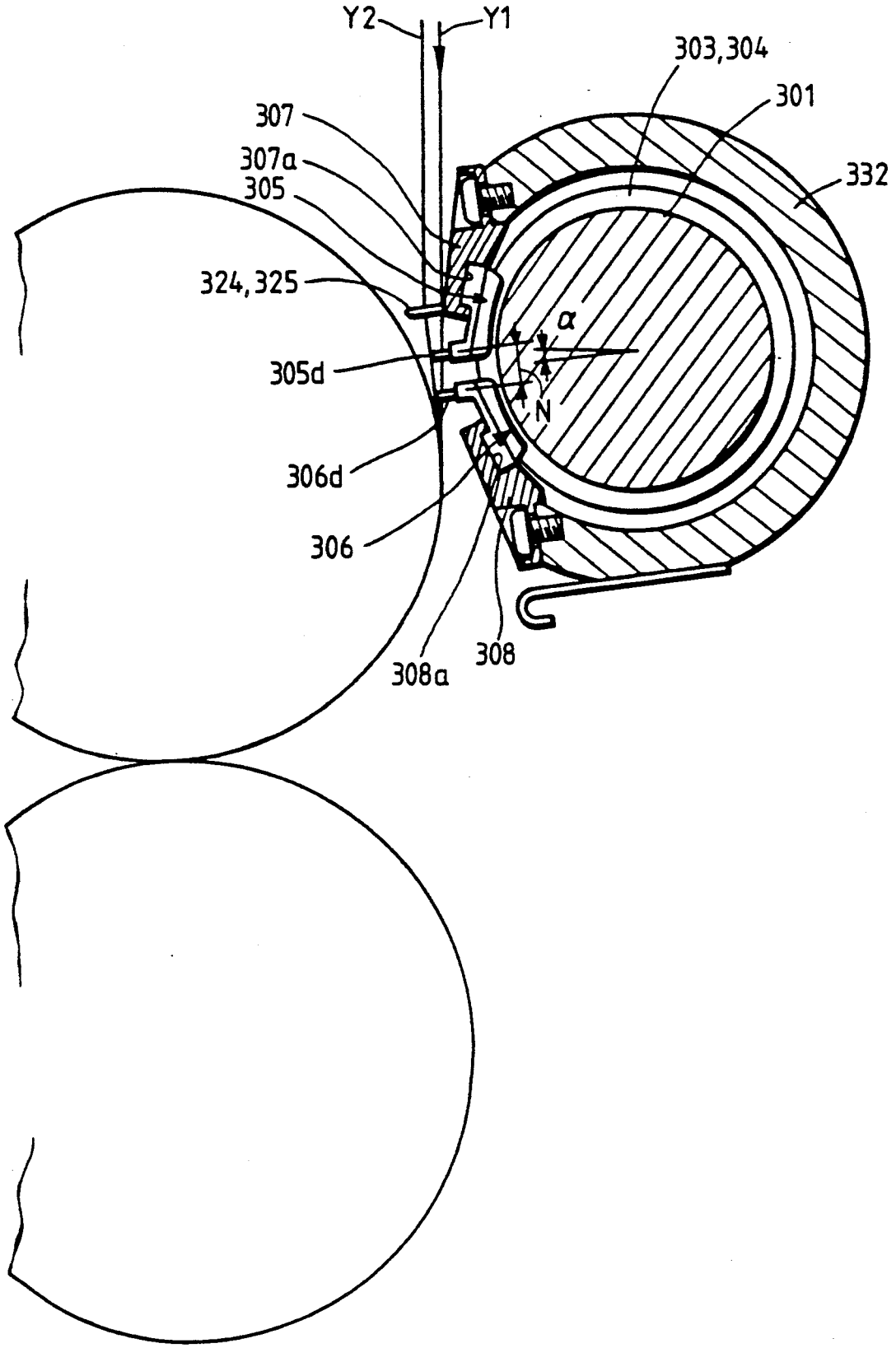

FIGS. 13 and 14 are sectional views of yarn traversing devices embodying the present device.

The yarn traversing device shown in FIG. 13 differs from that shown in FIG. 9 in the length of the yarn guide extensions of yarn guides. The yarn traversing device shown in FIG. 13 is provided with a first yarn guide 335 having a yarn guide extension 335*d*, and a second yarn guide 336 having a yarn guide extension 336*d*. The respective lengths of the yarn guide extensions 335*d* and 336*d* are L1 and L2 (L1>L2). When a yarn releasing guide 324 (325) acts on the yarn to shift the yarn to a path Y2, the extremities of the yarn guide extensions 335*d* and 336*d* are in contact with the yarn. In transferring the yarn, the yarn guide extensions 335*d* and 336*d* coincide with each other on the path Y2 of the yarn, so that the yarn is never allowed to float and interference is obviated.

The yarn traversing device shown in FIG. 14 differs from that shown in FIG. 9 in the position of a cam drum 332. The cam drum 332 is turned counterclockwise through an angle $\alpha$ s that the yarn guide extensions 305*d* and 306*d* of two yarn guides 305 and 306 extend perpendicularly to the path Y2 when a yarn releasing guide 324 (325) acts on the yarn. Thus, the extremities of the yarn guide extensions 305*d* and 306*d* are able to be in contact with the yarn running along the path Y2 even if the yarn guide extensions 305*d* and 6*d* are the same in length. Similarly to those shown in FIG. 13, the yarn guide extensions 305*d* and 306*d* coincide with each other on the path Y2 in transferring the yarn.

The two yarn guides of the yarn traversing device of the present device are disposed so that the extremities thereof are in contact with the yarn when the yarn releasing guide acts on the yarn, and one of the yarn guides is located directly below the other yarn guide on the path of the yarn at a moment when the yarn is released from the former yarn guide to prevent the yarn from floating and to prevent interference in transferring the yarn. Accordingly, the yarn can be traversed stably along a constant path by the cooperative action of the two yarn guides, and the possibility of occurrence of cobwebbing and winding the yarn in an irregular yarn package is reduced.

What is claimed is:

1. A method for traversing yarn, the yarn defining a yarn running direction, the method comprising:

providing a rotatable cam roller comprising first and second substantially helical cam channels, the first cam channel comprising a first active groove and a first return groove, the first active groove defining an endpoint C and an endpoint E, the second cam channel comprising a second active groove and a second return groove, the second active groove defining an endpoint B and an endpoint D, providing a first yarn guide for engaging the first cam channel, providing a second yarn guide for engaging the second cam channel, moving the first yarn guide along the first return groove and moving the second yarn guide along the second active groove substantially concurrently, moving the second yarn guide along the second return groove and moving the first yarn guide along the first active groove substantially concurrently, transferring yarn from the first yarn guide to the second yarn guide when the first yarn guide is at the endpoint E and the second yarn guide is at the endpoint D, and transferring yarn from the second yarn guide to the first yarn guide when the second yarn guide is at the endpoint B and the first yarn guide is at the endpoint C, whereby the traverse direction of the yarn is reversed substantially instantaneously when the yarn guides are at the endpoints of the active grooves.

2. A device for traversing yarn, the yarn defining a yarn running direction, the device comprising:

a rotatable cam roller comprising first and second substantially helical cam channels, the first cam channel comprising a first active groove and a first return groove, the first active groove defining an endpoint C and an endpoint E, the second cam channel comprising a second active groove and a second return groove, the second active groove defining an endpoint B and an endpoint D, a first yarn guide engaging the first cam channel, a second yarn guide engaging the second cam channel, the first and second yarn guides and the first and second cam channels being mutually disposed so that the first and second yarn guides being in spaced relationship relative to the yarn running direction, the first yarn guide engages the first return groove and the second yarn guide engages the second active groove substantially concurrently, the second yarn guide engages the second return groove and the first yarn guide engages the first active groove substantially concurrently, yarn is transferred from the first yarn guide to the second yarn guide when the first yarn guide is at the endpoint E and the second yarn guide is at the endpoint D, and yarn is transferred from the second yarn guide to the first yarn guide when the second yarn guide is at the endpoint B and the first yarn guide is at the endpoint C, whereby the traverse direction of the yarn is reversed substantially instantaneously when the yarn guides are at the endpoints of the active grooves.

3. A device for traversing yarn as in claim 2 wherein the yarn defines a virtual traverse range, the device comprising:

a yarn slip-off preventing guide disposed between the first and second yarn guides and within the virtual traverse range, and two yarn releasing guides, each of the two yarn releasing guides being disposed at opposite ends of the virtual traverse range.

4. A device for traversing yarn, comprising:

a rotary cam roller defining a rotational axis and a circumference having a first and second substantially helical cam channel therein, a first yarn guide engaging the first cam channel for traversing yarn relative to the cam roller, a second yarn guide engaging the second cam channel for traversing yarn relative to the cam roller, a first guide rail and a second guide rail disposed near the circumference of the cam roller and extending substantially parallel to the rotational axis of the cam roller, the first and second guide rails defining a gap therebetween, the first guide rail having a guide groove for guiding the first yarn guide, the second guide rail having a guide groove for guiding the second yarn guide, at least one of the first and second yarn guides comprising:

a shoe having a first end and a second end, a slider provided on the first end of the shoe for engaging the guide groove of at least one of the first and second guide rails, and a yarn guide extension provided on the second end of the shoe for projecting throughout the gap between the first and second guide rails.

5. A device for traversing yarn, the yarn defining a yarn running direction, the device comprising:

a cam roller, a first substantially helical cam channel in the circumference of the cam roller defining a first phase, a second substantially helical cam channel in the circumference of the cam roller defining a second phase, the second phase being unequal to the first phase, a first yarn guide engaging the first cam channel for traversing a yarn in a first traverse direction, a second yarn guide engaging the second cam channel for traversing the yarn in a second traverse direction, the second traverse direction being substantially opposite to the first traverse direction, the first and second yarn guides being disposed in spaced relationship relative to the yarn running direction, at least one of the first and second yarn guides comprising:

a first inclined side, a second inclined side, the first inclined side being relatively taller than the second inclined side, and a slit forming a yarn holding recess between the first inclined side and the second inclined side.

6. A device for traversing yarn as in claim 5, wherein each of the first and second yarn guides comprises:

a first inclined side, a second inclined side, the first inclined side being relatively taller than the second inclined side, and a slit forming a yarn holding recess between the first inclined side and the second inclined side, and wherein the first and second yarn guides are substantially axially symmetrically disposed.

7. A device for traversing yarn, the yarn defining a yarn running direction and a virtual traverse range, the device comprising:

a first yarn guide for traversing the yarn in a first traverse direction, a second yarn guide for traversing the yarn in a second traverse direction, the second traverse direction being substantially opposite to the first traverse direction, the first and second yarn guides being disposed in spaced relationship relative to the yarn running direction, a first yarn releasing guide for releasing the yarn from the first yarn guide, a second yarn releasing guide for releasing the yarn from the second yarn guide, the first and second yarn releasing guides being disposed respectively at opposite ends of the virtual traverse range, the first and second yarn guides and the first and second releasing guides being arranged so that at least a portion of each of the first and second yarn guides is in contact with the yarn when the first yarn releasing guide releases the yarn from the first yarn guide and when the second yarn releasing guide releases the yarn from the second yarn guide.

* * * * *